US008005389B2

(12) United States Patent
Miyazaki

(10) Patent No.: US 8,005,389 B2
(45) Date of Patent: Aug. 23, 2011

(54) FIXING DEVICE AND TEMPERATURE CONTROL METHOD THEREFOR

(75) Inventor: Yasunari Miyazaki, Shizuoka (JP)

(73) Assignees: Kabushiki Kaisha Toshiba, Tokyo (JP); Toshibec Tec Kabushiki Kaisha, Tokyo (JP)

( * ) Notice: Subject to any disclaimer, the term of this patent is extended or adjusted under 35 U.S.C. 154(b) by 133 days.

(21) Appl. No.: 12/419,751

(22) Filed: Apr. 7, 2009

(65) Prior Publication Data

US 2009/0257770 A1 Oct. 15, 2009

Related U.S. Application Data

(60) Provisional application No. 61/044,216, filed on Apr. 11, 2008.

(51) Int. Cl.
*G03G 15/20* (2006.01)
*G03G 15/00* (2006.01)

(52) U.S. Cl. ..... 399/69; 399/88

(58) Field of Classification Search ..... 399/33, 399/67, 69, 88, 328, 329
See application file for complete search history.

(56) References Cited

U.S. PATENT DOCUMENTS 6,861,630 B2 * 3/2005 Kinouchi et al. ..... 399/328 X
6,871,039 B2 * 3/2005 Murata ..... 399/329 X
6,889,018 B2 * 5/2005 Kinouchi et al. ..... 399/69
7,045,749 B2 * 5/2006 Kinouchi et al. ..... 399/328 X
7,186,959 B2 * 3/2007 Takagi et al. ..... 399/329 X
7,304,273 B2 * 12/2007 Kinouchi et al. ..... 399/69 X
7,340,192 B2 * 3/2008 Kinouchi et al. ..... 399/69

FOREIGN PATENT DOCUMENTS

JP 2001312178 11/2001
JP 2002229377 8/2002
JP 2008197135 8/2008

* cited by examiner

*Primary Examiner* — Sandra L Brase

(74) *Attorney, Agent, or Firm* — Turocy & Watson, LLP

(57) ABSTRACT

A fixing device includes a fixing belt, exercitation coils for induction-heating the fixing belt, power supplies that supply high-frequency power to the excitation coils, an output power detecting circuit that detects output electric energy of the power supplies, a power control circuit that controls the output electric energy of the power supplies, and temperature sensors that detect the temperature of a surface portion of the fixing belt. When electric energy applied to the excitation coils during the power fall reaches minimum power set in advance larger than 0 W, the power control circuit maintains the minimum power while the temperature detected by the temperature sensors is within a predetermined control temperature range and controls output power of the induction heating power supplies to shift from the minimum power to 0 W when the detected temperature deviates from the predetermined control temperature range.

20 Claims, 9 Drawing Sheets

| OPERATION PATTERN | CENTER COIL OPERATION TIME (sec) | SIDE COIL OPERATION TIME (sec) |
|---|---|---|
| 12 | 1.5 | 1 |
| 13 | 1.4 | 1 |
| 14 | 1.3 | 1 |
| 15 | 1.2 | 1 |
| 16 | 1.1 | 1 |
| 17 | 1 | 1 |
| 18 | 1 | 1.1 |
| 19 | 1 | 1.2 |
| 20 | 1 | 1.3 |
| 21 | 1 | 1.4 |
| 22 | 1 | 1.5 |

FIXING DEVICE AND TEMPERATURE CONTROL METHOD THEREFOR

CROSS-REFERENCE TO RELATED APPLICATION

This application is based upon and claims the benefit of priority from U.S. provisional application 61/044,216 filed on Apr. 11, 2008, the entire contents of which are incorporated herein by reference.

TECHNICAL FIELD

The present invention relates to an image forming apparatus, and, more particularly to temperature control for a fixing device of the image forming apparatus.

BACKGROUND

In an image forming apparatus such as a copying machine or a printer employing an electro photographic process, a toner image formed on a photoconductive drum is transferred onto a transfer member such as a transfer belt. Thereafter, the transferred toner image is melted by a fixing device including a pressing roller, a fixing roller and a fixing belt suspended around the fixing roller, and is fixed on a recording medium such as a sheet.

As a method of heating and melting a toner in the fixing device, for example, an induction heating system (an IH system) for feeding a high-frequency current to an induction coil, causing an induction current (an eddy-current) in a fixing roller or a fixing belt, causing the fixing roller or the fixing belt to generate heat is put to practical use.

In a fixing device of such an IH system, temperature control is performed by changing electric power supplied to the induction coil. The temperature of the fixing belt or the fixing roller is detected, maximum power is supplied until the detected temperature reaches target temperature, and electric power to be supplied is reduced when the temperature reaches the target temperature. Thereafter, in order to keep the temperature of the fixing belt or the fixing roller constant, the electric power to be supplied is switched between a set minimum power and 0 W. Such a control system is disclosed in, for example, JP-A-2002-229377 (Kyocera Mita Corporation).

On the other hand, in the fixing device of the IH system, there is known an external IH fixing system for arranging divided IH coils on the outside of the fixing device. In such a fixing system, the fixing device includes divided coils including a center coil that heats the center in a width direction or an axial direction of a fixing belt or a fixing roller and side coils that heat ends in the width direction or the axial direction of the fixing belt or the fixing roller. In power supply to the divided IH coils, the electric power is temporally alternately supplied in order to save the electric power.

In the case of the fixing device of the IH system including the divided coils, if power on and off control is performed in a state in which at least one of target portions of the fixing belt or the fixing roller heated by the divided IH coils does not reach control temperature, a deficiency that some portions are kept at the control temperature and the other portions are not kept at the control temperature occurs. This causes temperature unevenness in the width direction or the axial direction of the fixing belt and the fixing roller and causes fixing failure.

SUMMARY

According to an aspect of the present invention, there is provided a fixing device including a fixing member, an excitation coil for induction-heating the fixing member, an induction heating power supply that supplies high-frequency power to the excitation coil, an output power detection circuit that detects an output power of the induction heating power supply, a power control circuit that variably controls the output power of the induction heating power supply to increase or decrease at a predetermined period, and a temperature sensor that detects the temperature of a surface portion of the fixing member. When the power applied to the excitation coil reaches a minimum power set larger than 0 W, the power control circuit maintains the minimum power while the detected temperature detected by the temperature sensor is within a predetermined control temperature range and controls the output power of the induction heating power supply to shift from the minimum power to 0 W when the detected temperature deviates from the predetermined control temperature range.

According to another aspect of the present invention, the fixing device further includes a fixing roller forming the fixing member and a fixing belt suspended around the fixing roller, a center coil for induction-heating substantially the center in a width direction of the fixing belt, side coils for induction-heating ends in the width direction of the fixing belt, the side coils being arranged at least on one side of the center coil, a fixing belt center temperature sensor that detects surface temperature in substantially the center in the width direction of the fixing belt, and a fixing belt side temperature sensor that detects surface temperature at at least one end in the width direction of the fixing belt. The power control circuit variably controls an output power of the induction heating power supply to rise or fall until the detected temperature of the fixing belt center temperature sensor or the fixing belt side temperature sensor reaches predetermined temperature.

According to still another aspect of the present invention, the power control circuit includes a temperature comparing unit that compares, at a predetermined period, detected temperature T1 of the fixing belt center temperature sensor or detected temperature T2 of the fixing belt side temperature sensor with target temperature Ts. The power control circuit controls the output power of the induction heating power supply to rise or fall stepwise by a predetermined unit amount when the detected temperature T1 or T2 is different from the target temperature Ts.

According to still another aspect of the present invention, the induction heating power supply includes: a first high-frequency generating circuit that supplies high-frequency pulse voltage to the center coil, a second high-frequency generating circuit that supplies high-frequency pulse voltage to the side coils, a coil-driving control unit that alternately supplies, at a predetermined excitation time ratio, output power of the high-frequency generating circuits to the center coil and the side coils, and an excitation-time-ratio control unit that compares the detected temperature T1 of the fixing belt center temperature sensor and T2 of the fixing belt side temperature sensor and, when the detected temperature T1 and T2 are different, changes the excitation time ratio such that the detected temperature T1 and the detected temperature T2 coincide with each other.

According to still another aspect of the present invention, there is provided an image forming apparatus including a scanning unit that scans an image of an original document, a developing device that deposits a toner on an electrostatic latent image formed on an image bearing member to form a toner image on the basis of the image scanned by the scanning unit, a transfer device that transfers the toner image formed by the developing device onto a recording medium, and a fixing device that thermally fusion-bonds the toner image on the recording medium, which is transferred by the transfer device, to the recording medium. The fixing device includes: a fixing roller and a fixing belt suspended around the fixing roller, an excitation coil for induction-heating the fixing roller or the fixing belt, an induction heating power supply that supplies high-frequency power to the excitation coil, an output power detecting circuit that detects an output power of the induction heating power supply, a power control circuit that variably controls the output power of the induction heating power supply to increase or decrease at a predetermined period, and a temperature sensor that detects the temperature of a surface portion of the fixing roller or the fixing belt. When a power applied to the excitation coil during the power fall reaches the minimum power set larger than 0 W, the power control circuit maintains the minimum power while the detected temperature detected by the temperature sensor is within a predetermined control temperature range and controls the output power of the induction heating power supply to shift from the minimum power to 0 W when the detected temperature deviates from the predetermined control temperature range.

According to still another aspect of the present invention, there is provided a temperature control method for a fixing device, the temperature control method including: an act for induction-heating a fixing belt suspended around a fixing roller using an excitation coil to which high-frequency output power of an induction heating power supply is supplied, an act for detecting an output power of the induction heating power supply, an act for detecting the temperature of a surface portion of the fixing belt using a temperature sensor, and an act for variably controlling, on the basis of the temperature detected by the temperature sensor, the output power of the induction heating power supply to rise or fall at a predetermined cycle. In the control for the output power of the induction heating power supply, when a power applied to the excitation coil during the power fall reaches a minimum power set larger than 0 W, the output power of the induction heating power supply is controlled to maintain the minimum power while the detected temperature detected by the temperature sensor is within a predetermined control temperature range and shift from the minimum power to 0 W when the detected temperature deviate from the predetermined control temperature range.

DETAILED DESCRIPTION

An embodiment of the present invention is explained in detail below with reference to the accompanying drawings.

Figure 1:
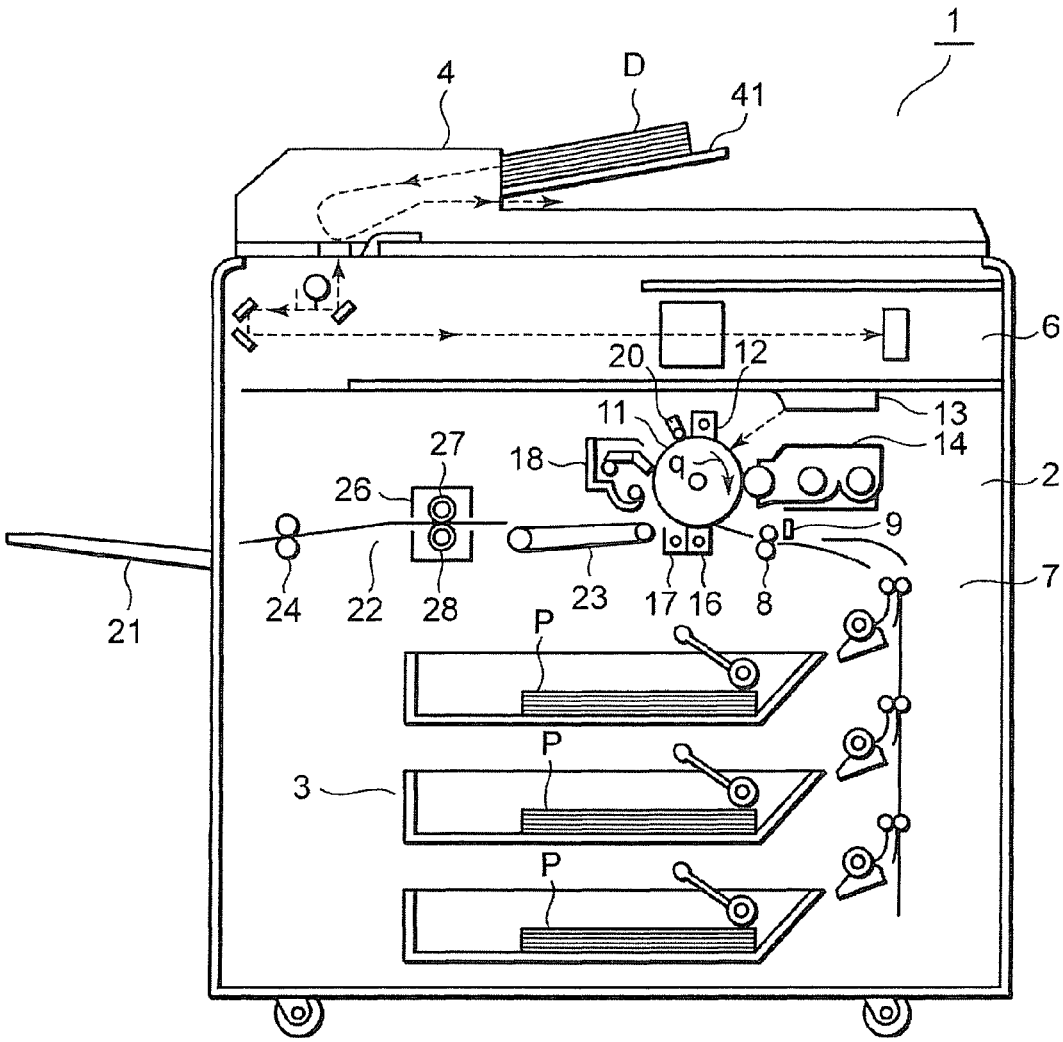
FIG. 1 is a schematic diagram of an overall configuration of a copying machine as an example of an image forming apparatus according to an embodiment of the present invention.

FIG. 1 is a schematic diagram of an overall configuration of a copying machine as an example of an image forming apparatus according to the embodiment of the present invention. An image forming apparatus 1 includes a cassette mechanism 3 that feeds a sheet P as a recording medium to an image forming unit 2 and includes, on an upper surface thereof, a scanner device 6 that scans an original document D fed by an auto document feeder 4. Registration rollers 8 are provided on a conveying path 7 leading from the cassette mechanism 3 to the image forming unit 2.

The image forming unit 2 includes, around a photoconductive drum 11, a charging device 12 that uniformly charges the photoconductive drum 11 sequentially along a rotating direction of the photoconductive drum 11 indicated by an arrow q, a laser exposing device 13 that forms a latent image on the charged photoconductive drum 11 on the basis of image data from the scanner device 6, a developing device 14, a transfer charger 16, a peeling charger 17, a cleaner 18, and a charge removing LED 20. The image forming unit 2 forms a toner image on the photoconductive drum 11 in an image forming process by the well-known electrophotographic system and transfers the toner image onto the sheet P.

In the image forming unit 2, a paper discharging and conveying path 22 for conveying the sheet P having the toner image transferred thereon in the direction of a paper discharge unit 21 is provided downstream in a conveying direction of the sheet P. A conveyor belt 23 that conveys the sheet P peeled from the photoconductive drum 11 to a fixing device 26 and a paper discharge roller 24 that discharges the sheet P after passage through the fixing device 26 to the paper discharge unit 21 are provided on the paper discharging and conveying path 22. The fixing device 26 includes a heat roller 27 and a pressing roller 28 that comes into press contact with the heat roller 27 with pressing force of, for example, 40 kg.

A configuration of the fixing device 26 is explained with reference to FIGS. 2 and 3.

The fixing device 26 heats a fixing belt and a fixing roller with electromagnetic induction heating (IH) using divided coils. The fixing device 26 includes a fixing roller 30, a band-like fixing belt 31 wound around the fixing roller 30 and heated, and a tension roller 32 that gives tension to the fixing belt 31 wound around the tension roller 32. The fixing belt 31 is composed, for example, of a metal base plate on which a silicone rubber layer and a fluorine-contained resin layer are laminated in this order. Traveling speed of the fixing belt 31 is process speed of the fixing device 26. The fixing device 26 also includes an induction heating coil 33 that directly heats the fixing belt 31 from the outside with the IH heating, an induction heating power supply 34 that supplies electric power to the induction heating coil 33, a fixing belt temperature sensor 35 that detects the surface temperature of the fixing belt 31, and a fixing-belt-temperature control unit 36 that controls the induction heating power supply 34 in order to control the temperature of an outer surface of the fixing belt 31 according to the temperature detected by the fixing belt temperature sensor 35. The fixing device 26 further includes a pressing roller 37 that is provided to be opposed to the fixing roller 30, around which the fixing belt 31 is wound, and is brought into press contact with the fixing roller 30 via the rear surface of the sheet P, a center heater 38*a* and a both end heater 38*b* incorporated in the pressing roller 37, a temperature sensor 39 that detects the outer surface temperature of the pressing roller 37, and a heater control unit 40 that performs excitation control for the center heater 38*a* and the both end heater 38*b* with the temperature detected by the temperature sensor 39.

Figure 3:
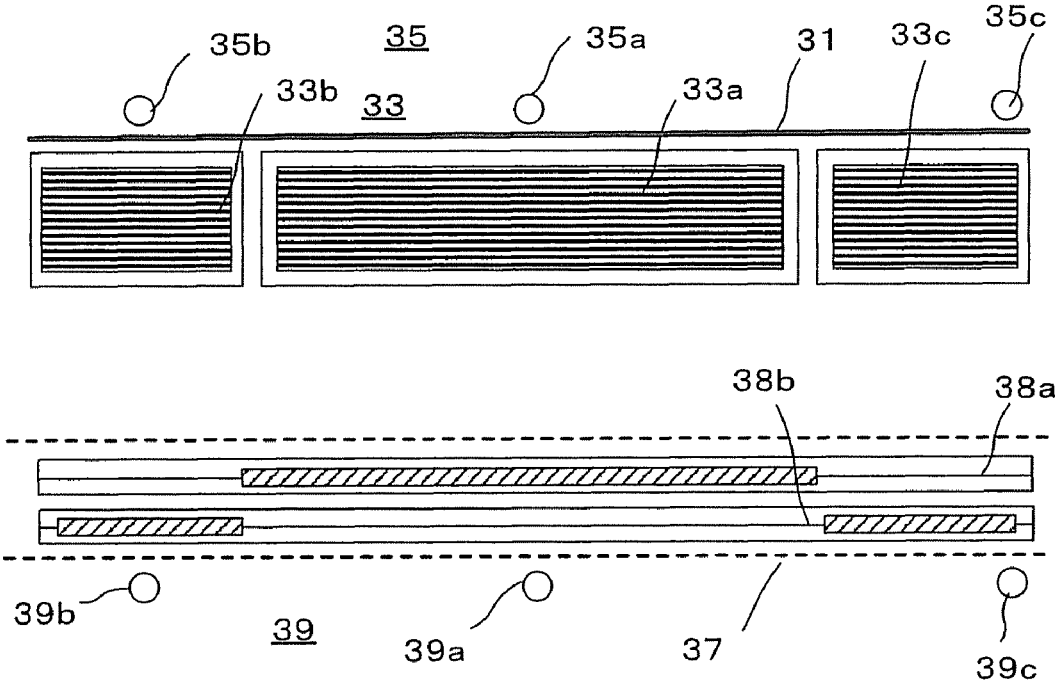
FIG. 3 is a schematic diagram of a configuration of divided coils included in the fixing device shown in FIG. 1.

FIG. 3 is a top view of a relation between the structure of the induction heating coil 33 and the temperature sensor 35 and a relation between the pressing roller 37 and the temperature sensor 39. As shown in the figure, the induction heating coil 33 is divided into three in an axial direction of the pressing roller 37. The induction heating coil 33 includes a center coil 33*a* in the center and two side coils 33*b* and 33*c* disposed on both sides of the center coil 33*a*. A part or all of these coils are driven according to the size of recording paper. The fixing belt 31 is electromagnetically induction-heated in the width direction according to the driving of the coils. The center coil 33*a* and the side coils 33*b* and 33*c* are driven by an alternate driving system. The center coil 33*a* and the side coils 33*b* and 33*c* are repeatedly driven in this way to maintain the fixing belt 31 at predetermined temperature.

The fixing belt temperature sensor 35 includes a fixing belt center temperature sensor 35*a* provided in a position corresponding to the center of the center coil 33*a* of the fixing belt 31, a fixing belt side temperature sensor 35*b* provided in a position corresponding to the center of the side coil 33*b*, and a fixing belt abnormal temperature sensor 35*c* that is provided near an outer end of the side coil 33*c* and detects abnormality.

The pressing roller 37 opposed to and brought into press contact with the fixing belt 31 incorporates the center heater 38*a* having a heating unit that mainly heats a center portion with respect to the axial direction on the surface of the pressing roller 37 and the both end heater 38*b* having a heating unit that mainly heats both end portions of the pressing roller 37. A heating portion of the center heater 38*a* corresponds to the center coil 33*a* of the induction heating coil 33. A heating portion of the both end heater 38*b* corresponds to the side coils 33*b* and 33*c* of the induction heating coil 33.

The temperature sensor 39 on the pressing roller side that detects the surface temperature of the pressing roller 37 includes a pressing center temperature sensor 39*a* provided near the center of the pressing roller 37 in order to detect the temperature of the center portion thereof, a pressing side temperature sensor 39*b* provided near the center of one heating unit of the both end heater 38*b*, and a pressing abnormal temperature sensor 39*c* provided near the end of the other heating unit of the both end heater 38*b*.

Figure 2:
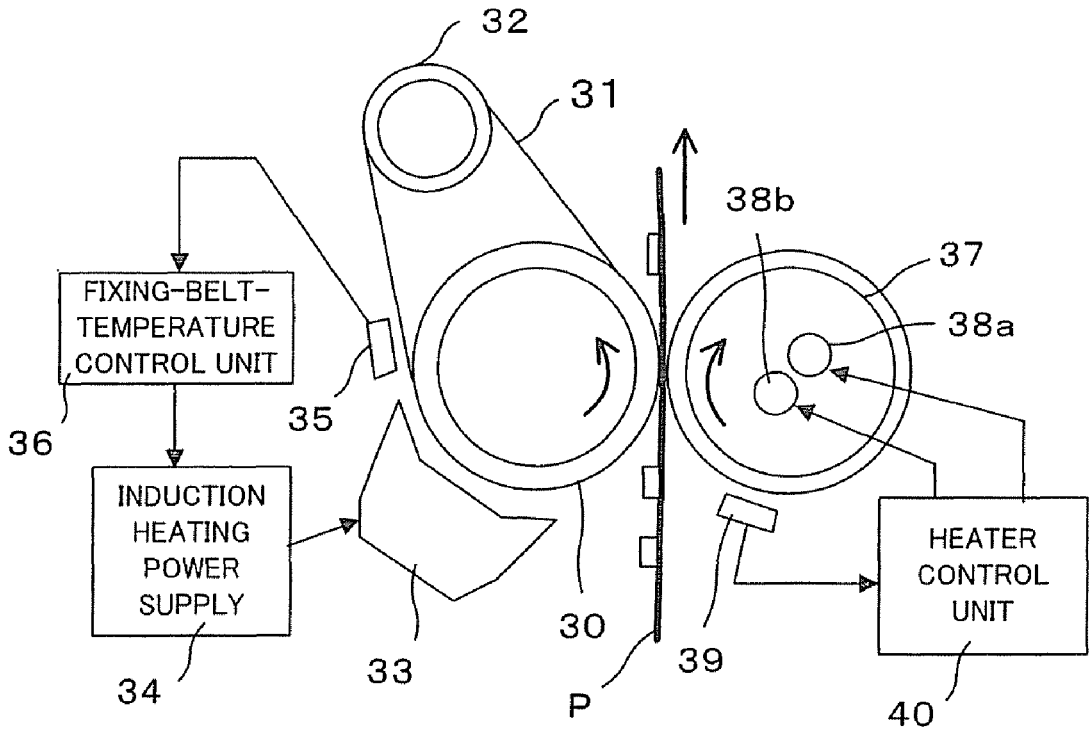
FIG. 2 is a schematic diagram of a configuration of a fixing device shown in FIG. 1.

The surface temperature detected in the axial direction of the pressing roller 37 by the pressing center temperature sensor 39*a* and the pressing side temperature sensor 39*b* is input to the heater control unit 40 shown in FIG. 2. The heater control unit 40 selectively energizes the center heater 38*a* and the both side heater 38*b*. When a temperature fall on the surface of the pressing roller 37 is detected by only the pressing center temperature sensor 39*a*, the heater control unit 40 energizes the center heater 38*a*. When a temperature fall on the surface of the pressing roller 37 is detected by the pressing center temperature sensor 39*a* and the pressing side temperature sensor 39*b*, the heater control unit 40 energizes the center heater 38*a* and the both side heater 38*b*.

The fixing belt center temperature sensor 35*a*, the fixing belt side temperature sensor 35*b*, the fixing belt abnormal temperature sensor 35*c*, the pressing center temperature sensor 39*a*, the pressing side temperature sensor 39*b*, and the pressing abnormal temperature sensor 39*c* are thermistors or thermopiles. The fixing belt abnormal temperature sensor 35*c* and the pressing abnormal temperature sensor 39*c* are temperature sensors for detecting abnormal heating of the ends of the side coil 33*c* and the both side heater 38*b*. The fixing belt center temperature sensor 35*a* and the pressing center temperature sensor 39*a* are sensors for detecting temperature changes (rise and fall) due to paper passage in the center portions of the center coil 33*a* and the pressing roller 37. The fixing belt side temperature sensor 35*b* and the pressing side temperature sensor 39*b* are sensors for detecting temperature changes due to paper passage in the side end portions of the side coil 33*b* and the pressing roller 37.

Thermal fluctuation in the center coil 33*a* and the side coils 33*b* and 33*c* is large because an alternating current is fed to heat the coils. Sudden fluctuation in detected temperature is small in the temperature sensors 39*a* and 39*b* on the pressing roller 37 side than the temperature sensors 35*a* and 35*b* on the IH coil side. Therefore, there is an advantage that temperature can be stably detected.

Figure 4:
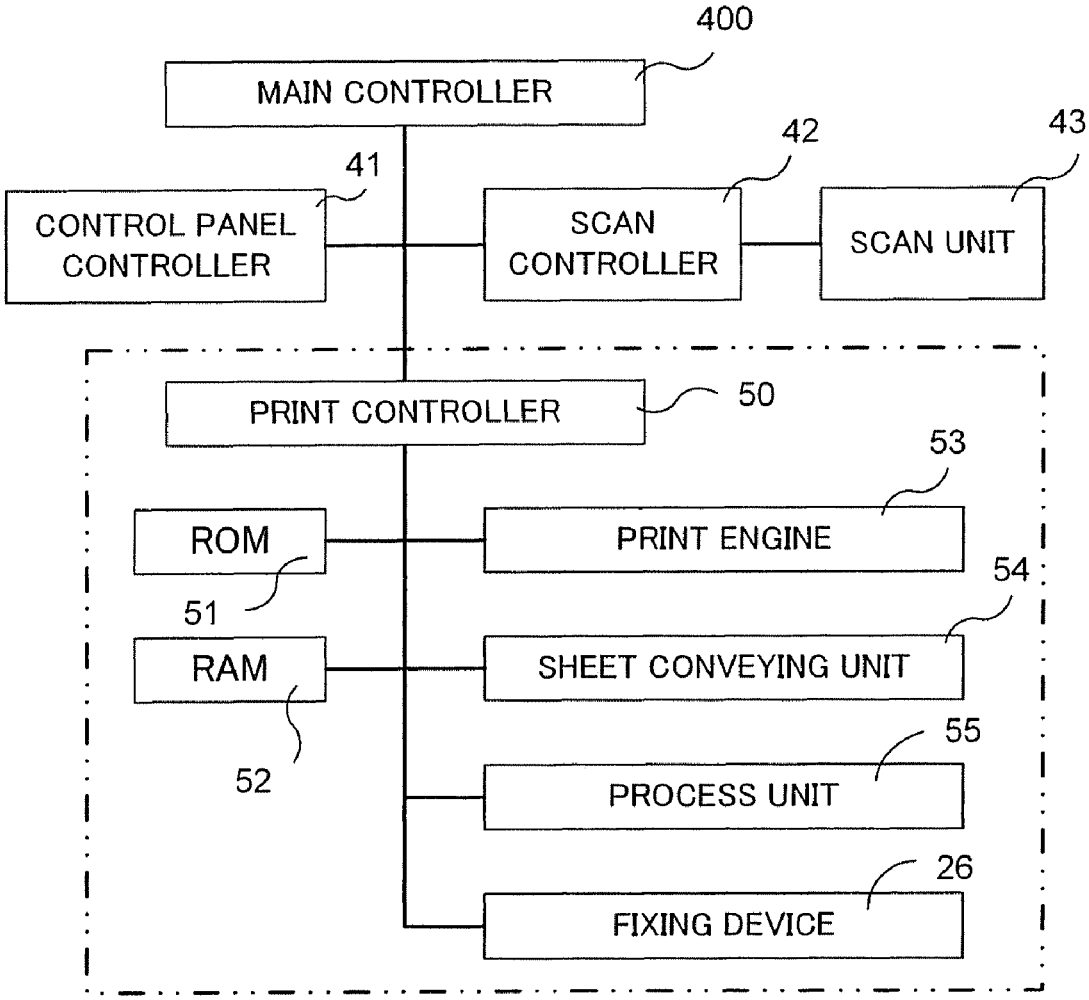
FIG. 4 is a block diagram of a control circuit of the image forming apparatus.

FIG. 4 is a block diagram of a control circuit of the image forming apparatus.

A control panel controller 41 and a scan controller 42 are connected to a main controller 400. The scan controller 42 is connected to a scan unit 43. A print controller 50 is connected to the main controller 400. The main controller 400 collectively controls the control panel controller 41, the scan controller 42, and the print controller 50. The scan controller 42 controls the scan unit 43 that optically scans an image of an original document.

A ROM 51 for control program storage, a RAM 52 for data storage, a print engine 53, a sheet conveying unit 54, a process unit 55, and the fixing device 26 are connected to the print controller 50. The print engine 53 emits a laser beam for forming the image scanned by the scan unit 43 on a photoconductive drum of the process unit 55. The sheet conveying unit 54 includes a conveying mechanism for the sheet P and a driving circuit for the conveying mechanism. The process unit 55 forms an electrostatic latent image corresponding to the image scanned by the scan unit 43 on the surface of the photoconductive drum with the laser beam emitted from the print engine 53, develops the electrostatic latent image formed on the photoconductive drum with a developer, and transfers the developer image onto the sheet P.

Figure 5:
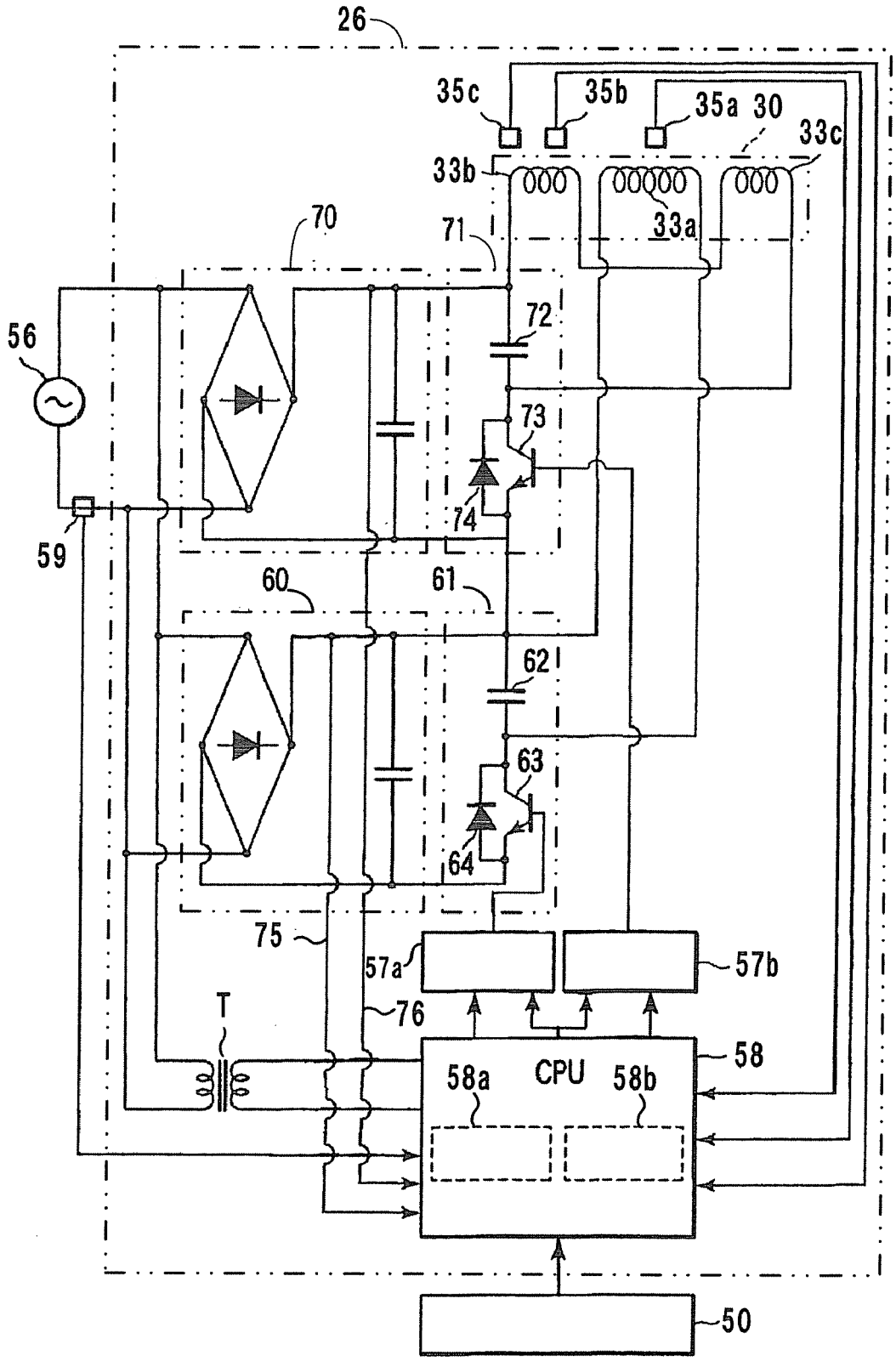
FIG. 5 is a block diagram of an electric circuit in the fixing device shown in FIG. 1.

FIG. 5 is a block diagram of an electric circuit in the fixing device 26.

A CPU 58 is connected to a commercial AC power supply 56 via a step-down transformer T. Rectifier circuits 60 and 70 are connected to the commercial AC power supply 56. High-frequency generating circuits (also referred to as switching circuits) 61 and 71 are connected to output terminals of the rectifier circuits 60 and 70.

The high-frequency generating circuit 61 includes a resonant capacitor 62 that forms a resonant circuit in conjunction with the center coil 33*a*, a switching element, for example, a transistor 63 that excites the resonant circuit, and a damper diode 64 connected in parallel to the transistor 63. In the high-frequency generating circuit 61, the transistor 63 is driven to be turned on and off by a center coil driving circuit 57*a* to thereby generate a high-frequency current. Therefore, the rectifier circuit 60 and the high-frequency generating circuit 61 are power supplies for supplying a high-frequency pulse signal to the center coil 33*a*, i.e., center coil power supplies.

The high-frequency generating circuit 71 includes a resonant capacitor 72 that forms a resonant circuit in conjunction with the side coils 33*b* and 33*c*, a switching element, for example, a transistor 73 that excites the resonant circuit, and a damper diode 74 connected in parallel to the transistor 73. In the high-frequency generating circuit 71, the transistor 73 is driven to be turned on and off by a side coil driving circuit 57*b* to thereby generate a high-frequency current. Therefore, the rectifier circuit 70 and the high-frequency generating circuit 71 are power supplies for supplying a high-frequency pulse signal to the side coils 33*b* and 33*c*, i.e., side coil power supplies.

As explained later, pulse-width modulated driving pulses are supplied to the center coil driving circuit 57*a* and the side coil driving circuit 57*b* from the CPU 58. Pulse widths of the driving pulses are variably controlled by a command signal from the image forming apparatus to the CPU 58. An output frequency of the high-frequency generating circuit 61 or the high-frequency generating circuit 71 is changed by such driving pulses. As a result, electric power supplied to the center coil 33*a* or the side coils 33*b* and 33*c* is changed.

The high-frequency currents are supplied to the center coil 33*a* and the side coils 33*b* and 33*c*, whereby high-frequency magnetic fields are generated from the center coil 33*a* and the side coils 33*b* and 33*c*. An eddy-current is generated in a metal member of the fixing roller 30 or of the fixing belt 31 by the high-frequency magnetic fields. The metal member generates heat with Joule heat based on the eddy-current.

The fixing belt center temperature sensor 35*a*, the fixing belt side temperature sensor 35*b*, the fixing belt abnormal temperature sensor 35*c*, the print controller 50, the center coil driving circuit 57*a*, and the side coil driving circuit 57*b* are connected to the CPU 58. Instead of the fixing belt center temperature sensor 35*a*, the fixing belt side temperature sensor 35*b*, and the fixing belt abnormal temperature sensor 35*c*, the pressing center temperature sensor 39*a*, the pressing side temperature sensor 39*b*, and the pressing abnormal temperature sensor 39*c* may be used. An output current from the commercial AC power supply 56 is detected by a current detecting circuit 59 and supplied to the CPU 58 as an input current value to the high-frequency generating circuits 61 and 71. Output voltages of the rectifier circuits 60 and 70 are supplied to the CPU 58 via wirings 75 and 76 as an input voltage value to the high-frequency generating circuit 61 and 71.

The CPU 58 includes a power control unit 58*a* and a coil-driving control unit 58*b*. The power control unit 58*a* controls electric power supplied to the center coil 33*a* and the side coils 33*b* and 33*c* such that detected temperature T1 of the fixing belt center temperature sensor 35*a* and detected temperature T2 of the fixing belt side temperature sensor 35*b* are maintained at set temperature Ts set in advance.

Figure 6:
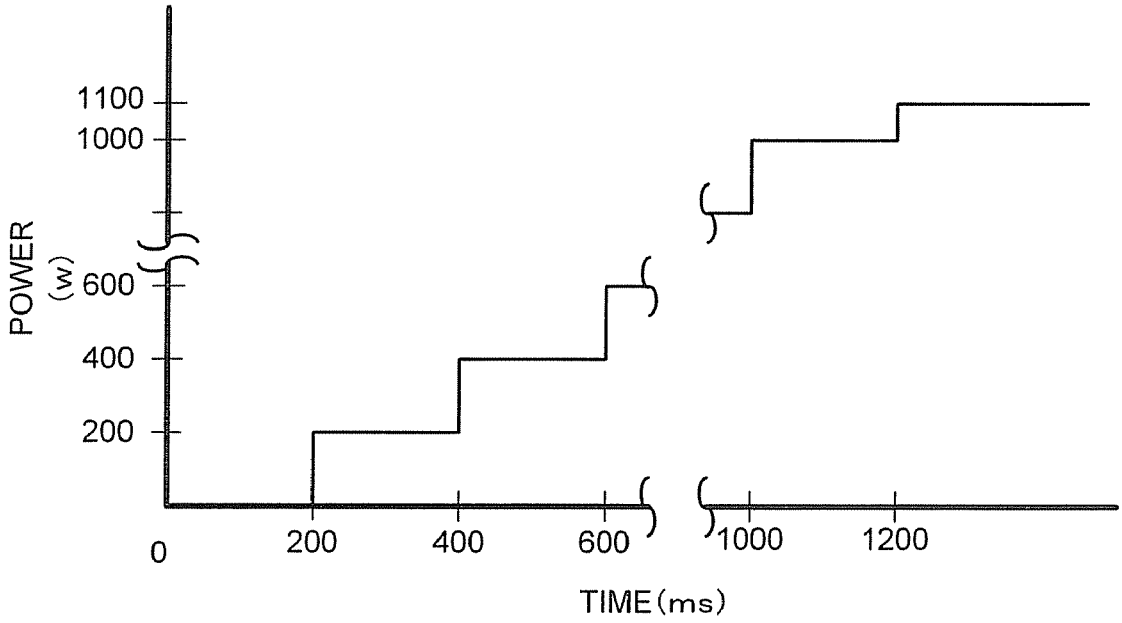
FIG. 6 is a graph of a change in electric power supplied to a center coil and side coils in a warming up (W/P) period at the start of the image forming apparatus.

FIG. 6 is a graph of a change in electric power supplied to the center coil 33*a* and the side coils 33*b* and 33*c* in a warming up (W/P) period at the start of the image forming apparatus. In the figure, the abscissa indicates time and the ordinate indicates output power of the high-frequency generating circuits 61 and 71. As shown in the figure, electric energy supplied to the coils is controlled to sequentially step up by, for example, 200 W at every 200 ms until the surface temperature of the fixing belt 31 reaches target temperature. The power control unit 58*a* of the CPU 58 executes this control according to a command from the print controller 50 shown in FIG. 5.

The coil-driving control unit 58*b* controls the supply of high-frequency power to the center coil 33*a* and the side coils 33*b* and 33*c* such that a temperature difference between the detected temperature T1 of the fixing belt center temperature sensor 35*a* and the detected temperature T2 of the fixing belt side temperature sensor 35*b* is maintained with the same value or within the predetermined value.

Figures 7, 8:
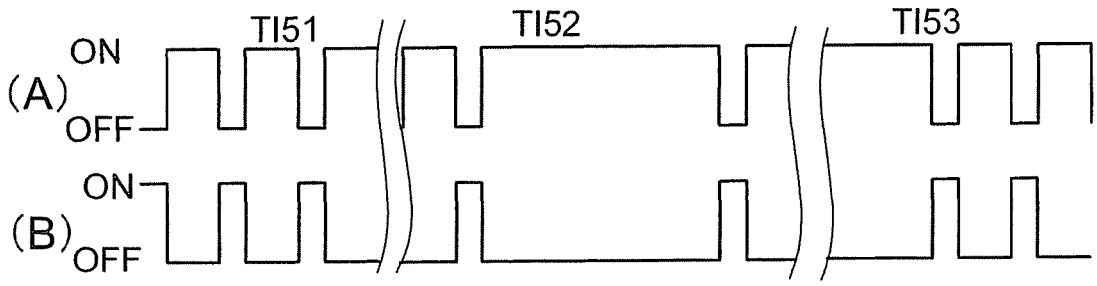
FIG. 7 is a waveform chart of a coil driving control pulse output from a coil-driving control unit of a CPU.
FIG. 8 is a table of formats representing operation patterns for causing the center coil and the side coils to alternately operate.

FIG. 7 is a waveform chart of a coil driving control pulse output from the coil-driving control unit 58*b* of the CPU 58. (A) of the figure is a driving pulse waveform for controlling to turn on and off the center coil driving circuit 57*a*. The center coil driving circuit 57*a* operates in an ON period of this pulse. The center coil driving circuit 57*a* amplifies a PWM modulated pulse supplied from the power control unit 58*a* of the CPU 58 and supplies the amplified PWM modulated pulse to the high-frequency generating circuit 61 to control to turn on and off the transistor 63 as the switching element thereof. High-frequency output of the high-frequency generating circuit 61 is supplied to the center coil 33*a*. In an OFF period of the driving pulse waveform shown in (A) of the figure, the center coil driving circuit 57*a* stops the operation. The PWM modulated pulse is not supplied to the high-frequency generating circuit 61. As a result, the supply of output from the high-frequency generating circuit 61 to the center coil 33*a* is stopped.

(B) of the figure is a driving pulse waveform for controlling to turn on and off the side coil driving circuit 57*b*. The side coil driving circuit 57*b* operates in an ON period of this pulse. The side coil driving circuit 57*b* amplifies a PWM modulated pulse supplied from the power control unit 58*a* of the CPU 58 and supplies the amplified PWM modulated pulse to the high-frequency generating circuit 71 to control to turn on and off the transistor 73 as the switching element thereof. High-frequency output of the high-frequency generating circuit 71 is supplied to the side coils 33*b* and 33*c*. In an OFF period of the driving pulse waveform shown in (B) of the figure, the side coil driving circuit 57*b* stops the operation. The PWM modulated pulse is not supplied to the high-frequency generating circuit 71. As a result, the supply of output from the high-frequency generating circuit 71 to the side coils 33*b* and 33*c* is stopped.

As it is evident from FIG. 7, when one of the driving pulse waveforms shown in (A) and (B) of the figure is at an ON level, the other is at an OFF level. Therefore, as explained above, the high-frequency output of the high-frequency generating circuit 61 is supplied to the center coil 33*a* in a period in which the waveform shown in (A) of the figure is at the ON level. In this period, since the waveform shown in (B) of the figure is at the OFF level, the high-frequency output of the high-frequency generating circuit 71 is not supplied to the side coils 33*b* and 33*c*.

Conversely, the high-frequency output of the high-frequency generating circuit 61 is not supplied to the center coil 33*a* in a period in which the waveform shown in (A) of the figure is at the OFF level. In this period, since the waveform shown in (B) of the figure is at the ON level, the high-frequency output of the high-frequency generating circuit 71 is supplied to the side coils 33*b* and 33*c*.

In this way, the driving pulse waveform (A) is a control signal waveform for controlling time for energizing the center coil 33*a* with high-frequency power. The driving pulse waveform (B) is a control signal waveform for controlling time for energizing the side coils 33*b* and 33*c* with high-frequency power. A duty ratio as a ratio of the ON and OFF periods in these driving pulse waveforms corresponds to a ratio of the excitation times for the coils. The duty ratio can be freely set. Pulse waveforms having different duty ratios can be combined. Such driving pulses are stored in advance in the RAM 52 shown in FIG. 4 as operation patterns for alternately actuating the center coil 33*a* and the side coils 33*b* and 33*c* at a predetermined duty ratio. Formats of these operation patterns are shown in FIG. 8.

Figure 9:
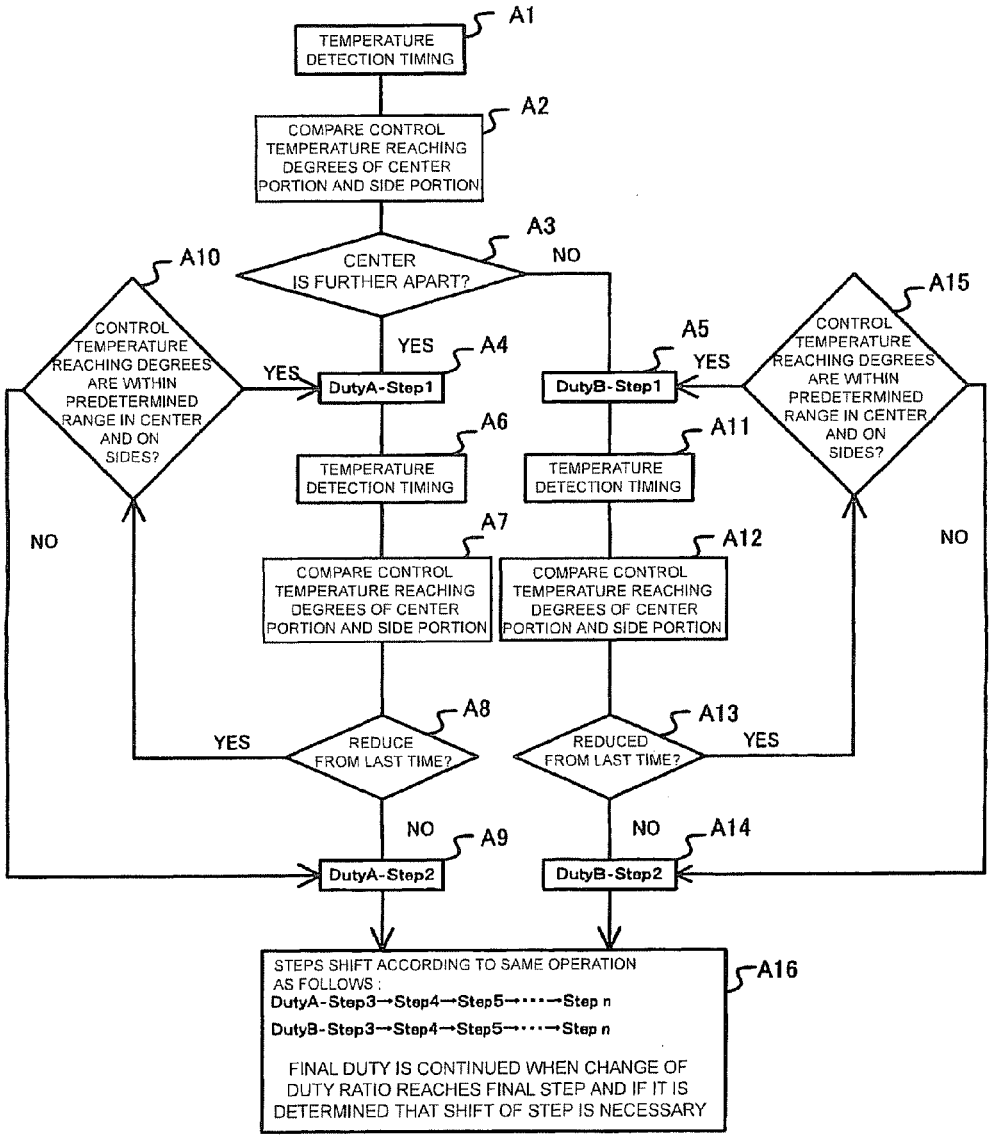
FIG. 9 is a flowchart for explaining duty change control in the fixing device shown in FIG. 1.

FIG. 9 is a flowchart for explaining duty change control in the fixing device 26.

First, in Act 1, the fixing device 26 detects, using the fixing belt center temperature sensor 35*a* and the fixing belt side temperature sensor 35*b*, the surface temperature of the fixing belt 31 at predetermined timing (A1). Temperature detected by the fixing belt center temperature sensor 35*a* is represented as T1 (hereinafter referred to as center temperature) and temperature detected by the fixing belt side temperature sensor 35*b* is represented as T2 (hereinafter referred to as side temperature). As temperature detection timing, the temperature is periodically detected at, for example, every 200 ms.

In Act 2, the fixing device 26 compares the detected center temperature T1 and the side temperature T2 with target temperature Ts (A2) In Act 3, the fixing device 26 determines which of the center temperature T1 and the side temperature T2 is further away from the target temperature Ts (A3). If the center temperature T1 is further away from the target temperature Ts (Yes in A3) the fixing device 26 shifts to Duty A-step 1 (A4). If the side temperature T2 is further away from the target temperature Ts (No in A3), the fixing device 26 shifts to Duty B-step 1 (A5). Duty A-step 1 means the supply of electric power at a duty ratio at which time for supplying the high-frequency power to the center coil 33*a* is longer than time for supplying the high-frequency power to the side coils 33*b* and 33*c*. On the other hand, Duty B-step 1 means the supply of electric power at a duty ratio at which time for supplying the high-frequency power to the side coils 33*b* and 33*c* is longer than time for supplying the high-frequency power to the center coil 33*a*.

After shifting to Duty A-step 1, the fixing device 26 detects the center temperature T1 and the side temperature T2 again in Act 6 at the next temperature detection timing (A6). In Act 7, the fixing device 26 compares the detected center temperature T1 and side temperature T2 with the target temperature Ts (A7). In Act 8, the fixing device 26 determines whether a difference between the center temperature T1 and the target temperature Ts is reduced from the difference in Act 2 (A8) As a result, if the difference is not reduced (No in A8), in Act 9, the fixing device 26 shifts to Duty A-step 2 (A9). In other words, when a temperature difference between the center temperature T1 and the side temperature T2 does not change, the duty ratio is changed to a duty ratio Duty A-step 2 with which a heating ratio of the center coil 33*a* is increased. These acts are repeatedly performed, the temperature in the center and the temperature on the sides are reversed, and, when the temperature in the center is higher, the duty ratio is changed to raise the temperature on the sides.

As a result of determination in Act 8, if the difference between the center temperature T1 and the target temperature Ts is reduced from the difference in Act 2 (Yes in A8), in Act 10, the fixing device 26 determines whether both the difference between the center temperature T1 and the target temperature Ts and the difference between the side temperature T2 and the target temperature Ts are within a predetermined range (A10). As a result of the determination, if the differences are within the predetermined range (Yes in A10), the fixing device 26 returns to Act 4 (A4) and repeats Act 4 (A4), Act 6 (A6), Act 7 (A7), and Act 8 (A8). When it is determined in Act 10 (A10) that the differences are not within the predetermined range (No in A10), the fixing device 26 returns to Act 9 (A9) and executes Duty A-step 2 (A9).

After shifting to Duty B-step 1 in Act 5, the fixing device 26 detects the center temperature T1 and the side temperature T2 again in Act 11 at the next temperature detection timing (A11). The fixing device 26 compares the detected center temperature T1 and side temperature T2 detected in Act 12 with the target temperature Ts (A12). In Act 13, the fixing device 26 determines whether a difference between the side temperature T2 and the target temperature Ts is reduced from the difference in Act 2 (A13). As a result, if the difference is not reduced (No in A13), in Act 14, the fixing device 26 shifts to Duty B-step 2 (A14). In other words, when a temperature difference between the center temperature T1 and the side temperature T2 does not change, the duty ratio is changed to a duty ratio Duty B-step 2 with which a heating ratio of the side coil 33*b* and 33*c* is increased. These acts are repeatedly performed, the temperature in the center and the temperature on the sides are reversed, and, when the temperature on the sides is higher, the duty ratio is changed to raise the temperature in the center.

As a result of determination in Act 13, if the difference between the side temperature T2 and the target temperature Ts is reduced from the difference in Act 2 (Yes in A13), in Act 15, the fixing device 26 determines whether both the difference between the center temperature T1 and the target temperature Ts and the difference between the side temperature T2 and the target temperature Ts are within a predetermined range (A15). As a result of the determination, if the differences are within the predetermined range (Yes in A15), the fixing device 26 returns to Act 5 (A5) and repeats Act 5 (A5), Act 11 (A11), Act 12 (A12), and Act 13 (A13). When it is determined in Act 15 (A15) that the differences are not within the predetermined range (No in A15), the fixing device 26 returns to Act 14 (A14) and executes Duty B-step 2 (A14) In Duty B-step 2, as explained later, the supply of electric power to the center coil 33*a* and the side coils 33*b* and 33*c* increases or decreases by one step.

After shifting to Duty A-step 2 in Act 9 (A9), the fixing device 26 shifts to Act 16. The fixing device 26 sequentially changes the duty ratio of power supply to the center coil 33*a* and the side coils 33*b* and 33*c* to step 3, step 4, step 5, . . . , and step n with the same operation (Al5). After shifting to Duty B-step 2 in Act 14 (A14), the fixing device 26 also shifts to Act 16. The fixing device 26 sequentially changes the duty ratio of power supply to the center coil 33*a* and the side coils 33*b* and 33*c* to step 3, step 4, step 5, . . . , and step n with (A16). After the change of the duty ratio reaches the final step, if it is determined that further shift of step is necessary, the final duty ratio is continued.

In this way, the same continuous duty control is also performed when the control temperature in the center and the control temperature on the sides are different and when the detected temperature reaches the target temperature and is maintained. It is possible to always perform temperature raise, temperature maintenance, and temperature lowering uniformly or with some temperature distribution by quickly and continuously repeating the operation explained above.

Figure 10:
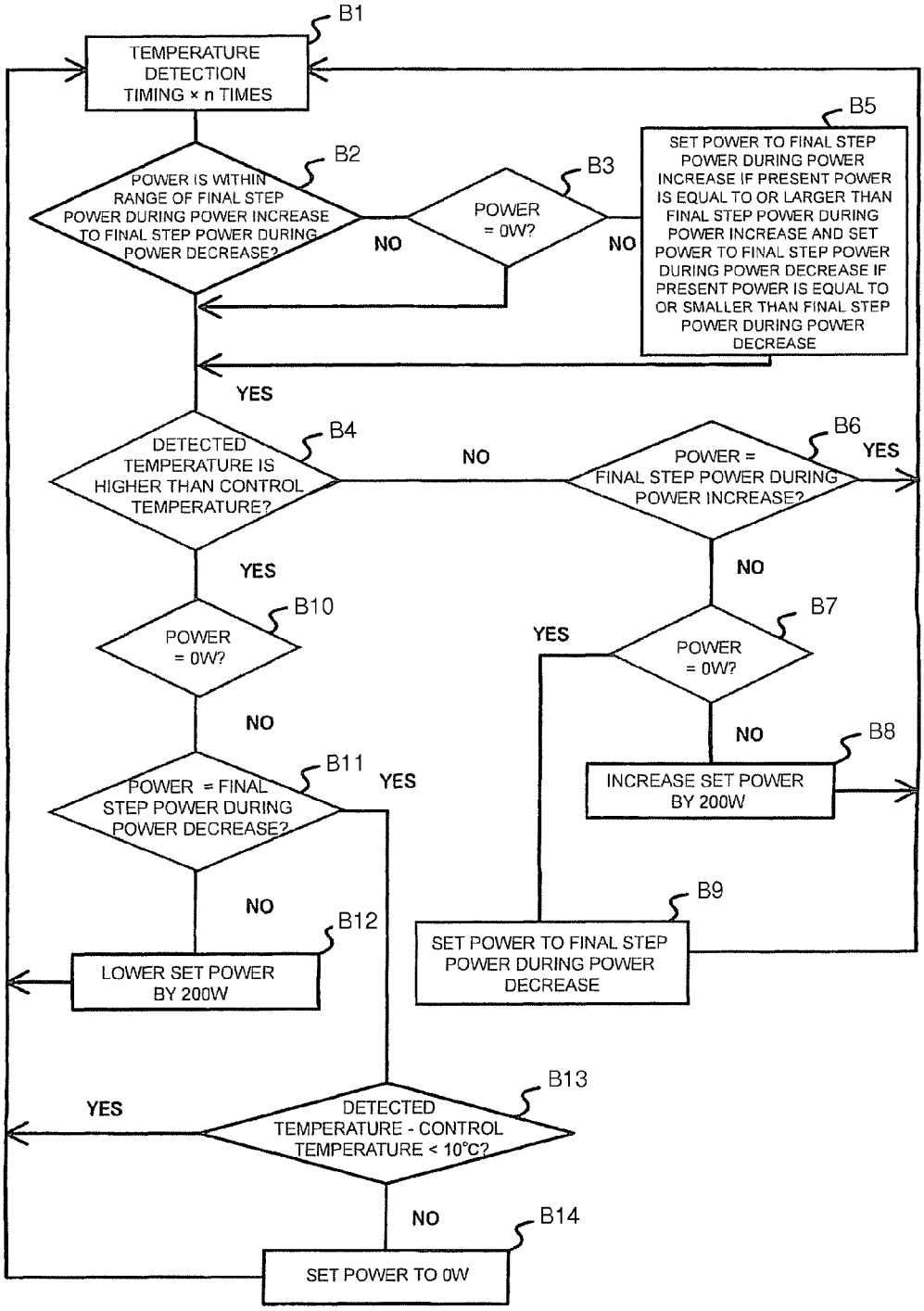
FIG. 10 is a flowchart for explaining power control in the fixing device in the embodiment.

FIG. 10 is a flowchart for explaining power control in the fixing device 26 according to this embodiment.

First, in Act 1, the fixing device 26 detects, using the fixing belt center temperature sensor 35*a* and the fixing belt side temperature sensor 35*b*, the temperature T1 and the temperature T2 of the fixing belt 31 at a fixed period of, for example, 200 ms (B1). Subsequently, in Act 2, the fixing device 26 checks whether a present power supplied to the fixing device 26 is within a range of an upper limit (a final step power during power rise) and a lower limit (a final step power during power fall) of a power set in advance (B2).

As a result of the check, if the present power is not within the set range of the power (No in B2), in Act 3, the fixing device 26 checks whether the power is 0 W (B3). If the power is 0 W, the fixing device 26 shifts to Act 4 (B4). If the power is not 0 W, in Act 5, if the present power is equal to or larger than the final step power during power rise set in advance, the fixing device 26 sets the power to the final step power. If the present power is equal to or smaller than the final step power during power fall set in advance, the fixing device 26 sets the power to the final step power. In both the cases, the fixing device 26 shifts to Act 4 (B5).

As a result of the check in Act 2, if the present power is within the set range of the power (Yes in B2), in Act 4, the fixing device 26 determines whether the detected temperature T1 and the detected temperature T2 of the fixing belt center temperature sensor 35*a* and the fixing belt side temperature sensor 35*b* are higher than the control target temperature Ts (B4). As a result of the determination, if the detected temperature T1 and the detected temperature T2 are not higher than the control target temperature Ts, in Act 6, the fixing device 26 checks whether the present power supplied to the fixing device 26 reaches an upper limit value (B6). If the present power reaches the upper limit value, the fixing device 26 feeds back the present power to Act 1 and prepares for temperature detection at the next (n+1) temperature detection timing (B1).

As a result of the check in Act 6, if the present power supplied to the fixing device 26 does not reach the upper limit value (No in B6), the fixing device 26 shifts to Act 7 and checks whether the present power supplied to the fixing device 26 is 0 W (B7). As a result of the check, if the present power is not 0 W, the fixing device 26 increases the set power by 200 W (B8), feeds back the increased power to Act 1, and prepares for the next (n+1) temperature detection timing (B1). As a result of the check in Act 7, if the power is 0 W, the fixing device 26 shifts to Act 9 and sets the power to a lower limit value (B9), feeds back the power to Act 1, and prepares for temperature detection at the next (n+1) temperature detection timing (B1).

On the other hand, if the detected temperature T1 and the detected temperature T2 are larger than the control target temperature Ts in act 4 (B4) (Yes in B4), in Act 10, the fixing device 26 checks whether the power is 0 W (B10). As a result, if the power is not 0 W (No in B10), in Act 11, the fixing device 26 checks whether the power is the lower limit value (B11) As a result of the check, if the power is not the lower limit value (No in B11), in Act 12, the fixing device 26 reduces the power by 200 W (B12). If the power is the lower limit value in Act 11 (Yes in Act 11), the fixing device 26 shifts to Act 12 and checks whether a difference between the detected temperatures T1 and T2 and the control target temperature Ts is equal to or smaller than 10° C. (B13). As a result, if the difference between the detected temperatures T1 and T2 and the control target temperature Ts is equal to or smaller than 10° C. (Yes in B13), the fixing device 26 feeds back the difference to Act 1, and prepares for the next (n+1) temperature detection timing (B1). As a result of the check in Act 13, if an absolute value of the difference between the detected temperatures T1 and T2 and the control target temperature Ts is equal to or larger than 10° C. (No in Act 13), the fixing device 26 sets the power supplied to the fixing device 26 to 0 W (B14), feeds back the power to Act 1, and prepares for the next (n+1) temperature detection timing (B1).

The fixing device 26 sets the power supplied to the fixing device 26 to a minimum power necessary for maintaining the target temperature by quickly and continuously repeating the operation explained above. With the flow explained above, it is possible to prevent the power from falling to 0 W as much as possible, prevent the power from falling to 0 W when a sheet enters the fixing device 26, and prevent a sudden fall in temperature of the fixing belt (roller).

As a condition for changing electric power, it is preferable to change the electric power when detected temperatures in all divided portions such as the center and the ends in the width direction of the fixing belt (roller) exceed a set range. However, the present invention is not limited to this. The electric power may be changed when detected temperature in any one of the portions exceeds the range.

As explained in the embodiment of the present invention, when the fall in electric power reaches the final step power, the electric power is not immediately shifted to 0 W and the final step power is maintained while detected temperature remains in a temperature range with respect to the control temperature, whereby frequent shift from the final step power to 0 W is prevented. As a result, it is possible to prevent temperature ripples of the coils due to ON and OFF of the IH power supply. It is possible to perform more precise temperature control of temperature distribution in the width (longitudinal) direction of the fixing belt (roller).

As explained above, by simultaneously performing the quick and continuous power change control and the quick and continuous duty ratio change control, it is possible to minimize turn-off of the IH power supply when quick alternating driving for the IH power supply is performed. It is possible to contribute to energy saving through optimization and reduction of a power consumption amount. Further, it is possible to more precisely control temperature distribution in the width direction (the longitudinal direction) of the fixing belt (roller).

What is claimed is:

1. A fixing device comprising:

a fixing member;

an excitation coil for induction-heating the fixing member;

an induction heating power supply that supplies high-frequency power to the excitation coil;

an output power detection circuit that detects an output power of the induction heating power supply;

a power control circuit that variably controls the output power of the induction heating power supply to increase or decrease in step wise between an upper limit and a lower limit, which is a minimum power larger than 0W, at a predetermined cycle; and a temperature sensor that detects temperature of a surface portion of the fixing member, wherein when the power applied to the excitation coil reaches a minimum power set larger than 0 W, the power control circuit maintains the minimum power while the detected temperature detected by the temperature sensor is within a predetermined control temperature range and controls the output power of the induction heating power supply to shift from the minimum power to 0 W when the detected temperature deviates from the predetermined control temperature range.

2. The device according to claim 1, further comprising:

a fixing roller forming the fixing member and a fixing belt suspended around the fixing roller;

a center coil for induction-heating substantially a center in a width direction of the fixing belt;

side coils for induction-heating ends in the width direction of the fixing belt, the side coils being arranged at least on one side of the center coil;

a fixing belt center temperature sensor that detects surface temperature in substantially the center in the width direction of the fixing belt; and a fixing belt side temperature sensor that detects surface temperature at least one end in the width direction of the fixing belt, wherein the power control circuit variably controls an output power of the induction heating power supply to rise or fall until the detected temperature of the fixing belt center temperature sensor or the fixing belt side temperature sensor reaches predetermined temperature.

3. The device according to claim 2, wherein the power control circuit includes a temperature comparing unit that compares, at a predetermined period, detected temperature T1 of the fixing belt center temperature sensor or detected temperature T2 of the fixing belt side temperature sensor with target temperature Ts and the power control circuit controls the output power of the induction heating power supply to rise or fall stepwise by a predetermined unit amount when the detected temperature T1 or T2 is different from the target temperature Ts.

4. The device according to claim 3, wherein the induction heating power supply includes:

a first high-frequency generating circuit that supplies high-frequency pulse voltage to the center coil;

a second high-frequency generating circuit that supplies high-frequency pulse voltage to the side coils;

a coil-driving control unit that alternately supplies, at a predetermined excitation time ratio, output power of the high-frequency generating circuits to the center coil and the side coils; and an excitation-time-ratio control unit that compares the detected temperature T1 of the fixing belt center temperature sensor and the detected temperature T2 of the fixing belt side temperature sensor and, when the detected temperature T1 and the detected temperature T2 are different, changes the excitation time ratio such that the detected temperature T1 and the detected temperature T2 coincide with each other.

5. The device according to claim 4, wherein a period for changing the excitation time ratio is the same as the period for variably controlling the power.

6. The device according to claim 5, wherein the side coils are arranged on both sides of the center coil.

7. The device according to claim 6, wherein the fixing belt of the fixing device is suspended around the tension roller and given tension.

8. The device according to claim 7, wherein the induction heating power supply includes a rectifier circuit that converts a commercial AC power supply into a direct current, and a DC output of the rectifier circuit is supplied to the first high-frequency generating circuit and the second high-frequency generating circuit.

9. The device according to claim 8, wherein the first high-frequency generating circuit and the second high-frequency generating circuit include switching elements that are controlled to be turned on and off by a PWM modulated output pulse of the power control circuit.

10. The device according to claim 2, wherein, when a power applied to the excitation coil during the power fall reaches the minimum power set larger than 0 W, the power control circuit maintains the minimum power while the detected temperature detected by any one of the fixing belt center temperature sensor and the fixing belt side temperature sensor is within the predetermined control temperature range and controls the output power of the induction heating power supply to shift from the minimum power to 0 W when the detected temperature deviates from the predetermined control temperature range.

11. The device according to claim 2, wherein, when a power applied to the excitation coil during the power fall reaches the minimum power set in advance larger than 0 W, the power control circuit maintains the minimum power while all the detected temperatures detected by the fixing belt center temperature sensor and the fixing belt side temperature sensor are within the predetermined control temperature range and controls the output power of the induction heating power supply to shift from the minimum power to 0 W when all the detected temperatures deviate from the predetermined control temperature range.

12. The device according to claim 11, wherein the power control circuit includes a temperature comparing unit that compares, at a predetermined period, detected temperature T1 of the fixing belt center temperature sensor or detected temperature T2 of the fixing belt side temperature sensor with target temperature Ts and the power control circuit controls the output power of the induction heating power supply to increase or decrease by a predetermined unit amount when the detected temperature T1 or T2 is different from the target temperature Ts.

13. The device according to claim 12, wherein the induction heating power supply includes:

a first high-frequency generating circuit that supplies high-frequency pulse voltage to the center coil;

a second high-frequency generating circuit that supplies high-frequency pulse voltage to the side coils;

a coil-driving control unit that alternately supplies, at a predetermined excitation time ratio, output power of the high-frequency generating circuits to the center coil and the side coils; and an excitation-time-ratio control unit that compares the detected temperature T1 of the fixing belt center temperature sensor and the detected temperature T2 of the fixing belt side temperature sensor and, when the detected temperature T1 and the detected temperature T2 are different, changes the excitation time ratio such that the detected temperature T1 and the detected temperature T2 coincide with each other.

14. The device according to claim 13, wherein a period for changing the excitation time ratio is the same as the period for variably controlling the power.

15. The device according to claim 14, wherein the side coils are arranged on both sides of the center coil.

16. An image forming apparatus comprising:

a scanner that scans an image of an original document;

a developing device that deposits a toner on an electrostatic latent image formed on an image bearing member to form a toner image on the basis of the image scanned by the scanning unit;

a transfer device that transfers the toner image formed by the developing device onto a recording medium; and a fixing device that thermally fusion-bonds the toner image on the recording medium, which is transferred by the transfer device, to the recording medium, wherein the fixing device includes:

a fixing roller and a fixing belt suspended around the fixing roller;

an excitation coil for induction-heating the fixing roller or the fixing belt; an induction heating power supply that supplies high-frequency power to the excitation coil;

an output power detecting circuit that detects an output power of the induction heating power supply;

a power control circuit that variably controls the output power of the induction heating power supply to increase or decrease in step wise between an upper limit and a lower limit, which is a minimum power larger than 0W, at a predetermined cycle; and a temperature sensor that detects the temperature of a surface portion of the fixing roller or the fixing belt, wherein when a power applied to the excitation coil reaches a minimum power set larger than 0 W, the power control circuit maintains the minimum power while the detected temperature detected by the temperature sensor is within a predetermined control temperature range and controls the output power of the induction heating power supply to shift from the minimum power to 0 W when the detected temperature deviates from the predetermined control temperature range.

17. The apparatus according to claim 16, wherein the excitation coil includes:

a center coil for induction-heating substantially a center in a width direction of the fixing belt; and side coils for induction-heating ends in the width direction of the fixing belt, the side coils being arranged at least on one side of the center coil.

18. The apparatus according to claim 17, wherein the induction heating power supply includes:

a first high-frequency generating circuit that supplies high-frequency pulse voltage to the center coil;

a second high-frequency generating circuit that supplies high-frequency pulse voltage to the side coils;

a coil-driving control unit that alternately supplies, at a predetermined excitation time ratio, output power of the high-frequency generating circuits to the center coil and the side coils; and an excitation-time-ratio control unit that compares the detected temperature T1 of the fixing belt center temperature sensor and the detected temperature T2 of the fixing belt side temperature sensor and, when the detected temperature T1 and the detected temperature T2 are different, changes the excitation time ratio such that the detected temperature T1 and the detected temperature T2 coincide with each other.

19. A temperature control method for a fixing device, the temperature control method comprising:

induction-heating a fixing belt suspended around a fixing roller using an excitation coil to which high-frequency output power of an induction heating power supply is supplied;

detecting an output power of the induction heating power supply;

detecting the temperature of a surface portion of the fixing belt using a temperature sensor; and variably controlling, on the basis of the temperature detected by the temperature sensor, the output power of the induction heating power supply to rise or fall at a predetermined cycle, wherein in the control for the output power of the induction heating power supply, when a power applied to the excitation coil reaches a minimum power set larger than 0 W, the output power of the induction heating power supply is controlled to maintain the minimum power while the detected temperature detected by the temperature sensor is within a predetermined control temperature range and shift from the minimum power to 0 W when the detected temperature deviate from the predetermined control temperature range.

20. The method according to claim 19, wherein the excitation coil includes:

a center coil for induction-heating substantially a center in a width direction of the fixing belt; and side coils for induction-heating ends in the width direction of the fixing belt, the side coils being arranged at least on one side of the center coil, the temperature sensor includes:

a fixing belt center temperature sensor that detects surface temperature in substantially the center in the width direction of the fixing belt; and a fixing belt side temperature sensor that detects surface temperature at at least one end in the width direction of the fixing belt, and the change control for the output power of the induction heating power supply is, when a power applied to the excitation coil during the power fall reaches the minimum power set in advance larger than 0 W, maintaining the minimum power while all the detected temperatures detected by the fixing belt center temperature sensor and the fixing belt side temperature sensor are within the predetermined control temperature range and controlling the output power of the induction heating power supply to shift from the minimum power to 0 W when all the detected temperatures deviate from the predetermined control temperature range.

* * * * *